US010802445B2

(12) United States Patent
Monferrer et al.

(10) Patent No.: US 10,802,445 B2
(45) Date of Patent: Oct. 13, 2020

(54) WINDING MECHANISM OF A TIMEPIECE

(71) Applicant: Montres Jaquet Droz SA, La Chaux-de-Fonds (CH)

(72) Inventors: Bernat Monferrer, St-Prex (CH); Edmond Capt, Le Brassus (CH)

(73) Assignee: Montres Jaquet Droz SA, La Chaux-de-Fonds (CH)

( * ) Notice: Subject to any disclaimer, the term of this patent is extended or adjusted under 35 U.S.C. 154(b) by 322 days.

(21) Appl. No.: 15/919,258

(22) Filed: Mar. 13, 2018

(65) Prior Publication Data

US 2018/0267475 A1 Sep. 20, 2018

(30) Foreign Application Priority Data

Mar. 17, 2017 (EP) ..... 17161690

(51) Int. Cl.
*G04B 27/04* (2006.01)
*G04B 27/02* (2006.01)
(Continued)

(52) U.S. Cl.
CPC ..... *G04B 27/04* (2013.01); *G04B 3/006* (2013.01); *G04B 27/026* (2013.01); *G04B 37/062* (2013.01)

(58) Field of Classification Search
CPC ..... G04B 3/00; G04B 3/006; G04B 27/02; G04B 27/026; G04B 27/04; G04B 37/062
See application file for complete search history.

(56) References Cited

U.S. PATENT DOCUMENTS

2010/0187074 A1* 7/2010 Manni ..... G04C 3/004 200/4
2014/0056112 A1 2/2014 Villaret

FOREIGN PATENT DOCUMENTS

CH 35 121 A 11/1905
CH 47 977 A 8/1909
(Continued)

OTHER PUBLICATIONS

Machine Translation of CH330202 (Year: 1958).*
(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A winding mechanism is for a timepiece including at least one first and one second power accumulators. The winding mechanism includes a winding stem, a winding pinion and a sliding pinion having face gear toothings, facing one another. The winding stem and the sliding pinion occupy the same axial winding position. The winding mechanism includes a coupling device which cooperates with the winding pinion and is provided to occupy a first coupling position for coupling the winding pinion and the first power accumulator when the winding stem is turned in one direction, the second power accumulator being uncoupled, without any contact with the coupling device, and a second coupling position for coupling the winding pinion and the second power accumulator when the winding stem is turned in the other direction, the first power accumulator being uncoupled, without any contact with the coupling device.

12 Claims, 5 Drawing Sheets

(51) Int. Cl.
*G04B 3/00* (2006.01)
*G04B 37/06* (2006.01)

(56) References Cited

FOREIGN PATENT DOCUMENTS

| | | | |
|---|---|---|---|
| CH | 151 727 | A | 12/1931 |
| CH | 330 202 | A | 5/1958 |
| CH | 708 340 | A2 | 1/2015 |
| EP | 2 701 014 | A1 | 2/2014 |

OTHER PUBLICATIONS

European Search Report dated Nov. 24, 2017 in EP 17161690.7, filed Mar. 17, 2017 (with English Translation of Categories of Cited Documents).

* cited by examiner

WINDING MECHANISM OF A TIMEPIECE

This application claims priority from European Patent Application No. 17161690.7 filed on Mar. 17, 2017; the entire disclosure of which is incorporated herein by reference.

FIELD OF THE INVENTION

The invention relates to a winding mechanism of a timepiece comprising at least one power accumulator provided in order to supply a first mechanism with power and a second power accumulator provided in order to supply a second mechanism with power, said winding mechanism comprising a winding stem, a winding pinion and a sliding pinion carried by said winding stem and having face gear (or dog coupling) toothings, facing one another, provided in order to allow driving of the winding pinion by the sliding pinion in the two directions of rotation of the winding stem, said winding stem and the sliding pinion occupying the same axial winding position. The invention relates likewise to a timepiece comprising such a winding mechanism.

BACKGROUND OF THE INVENTION

Such a winding mechanism is, for example, described in the patent CH 330202. This document describes a pocket alarm clock comprising a first power accumulator formed by the movement spring barrel and a second power accumulator formed by the striking mechanism spring barrel. The mechanism comprises a winding stem provided in order to effect all the controls of the movement and of the alarm, and in particular to set the time of the movement and of the striking mechanism, but likewise the winding of the movement spring barrel or the striking mechanism spring barrel by turning, in one direction or in the other, the winding stem when it occupies its median winding position. To this end, the sliding pinion is meshed with the winding pinion by face gear teeth, and there is provided a crown wheel meshed with the winding pinion, and two crown gears, both meshing with the crown wheel and intended to cooperate respectively with the ratchet of each of the spring barrels. Meshing of the crown gears with the corresponding ratchet of the spring barrel is ensured by a spring which acts on the axes of the crown gears in order to push them and make them engage with the corresponding ratchet. When the winding stem is turned in one direction or in the other, by the tangential force exerted by the crown wheel on the gears, one of the crown gears operates the winding of the corresponding spring barrel whilst the other performs the unclicking operation. Unclicking entails a persistently weak, cyclical contact between the parts. Such a mechanism is delicate because of the permanent stress of the spring in order to ensure good meshing of the crown gears with the corresponding ratchet. A loss of efficiency of the spring, by fatigue or by ageing, involves the risk that one or other of the gears no longer cooperates with the corresponding ratchet so that the associated spring barrel will no longer be able to be wound. Another disadvantage is wear and tear of the crown gears during the unclicking operation. Furthermore, this construction necessitates checking of the manufacturing tolerances of the spring.

The patent CH 47977 likewise describes a mechanism for winding and setting the time of a pocket alarm clock with two spring barrels. This mechanism comprises a winding ratchet of the movement spring barrel which is constantly engaged with a crown wheel which meshes with a winding pinion, and is disposed in order to actuate the movement spring barrel shaft only in one direction of rotation of the stem. The winding ratchet of the movement spring barrel is used in order to transmit the inverse movement of rotation of the stem, either to the winding ratchet of the alarm spring barrel, or to the alarm wheel by a gear pivoted on a rocker manoeuvrable from outside the watch. This mechanism has the disadvantage of requiring actuation of an external control in addition to rotation of the winding stem in order to wind the striking mechanism spring barrel.

SUMMARY OF THE INVENTION

The subject of the invention is in particular to remedy the various disadvantages of known devices.

More precisely, one object of the invention is to provide a winding mechanism which allows winding of two power accumulators by the single rotation of the winding stem in the two directions.

Likewise, the object of the invention is to provide a winding mechanism which allows winding of two power accumulators having great precision and being reliable over time.

Likewise, the object of the invention is to provide a winding mechanism which allows winding of two power accumulators of a simplified construction.

To this end, the present invention relates to a winding mechanism of a timepiece comprising at least one first power accumulator provided in order to supply a first mechanism with power and a second power accumulator provided in order to supply a second mechanism with power, said winding mechanism comprising a winding stem, a winding pinion and a sliding pinion carried by said winding stem and having face gear toothings, facing one another, provided in order to allow driving of the winding pinion by the sliding pinion in the two directions of rotation of the winding stem, said winding stem and the sliding pinion occupying the same axial winding position.

According to the invention, the winding mechanism comprises a coupling device which cooperates with the winding pinion and is provided in order to occupy a first coupling position for coupling the winding pinion and the first power accumulator when the winding stem is turned in one direction, the second power accumulator being uncoupled, without any contact with said coupling device, and a second coupling position for coupling the winding pinion and the second power accumulator when the winding stem is turned in the other direction, the first power accumulator being uncoupled, without any contact with said coupling device.

Hence, the winding mechanism according to the invention makes it possible to wind two power accumulators by the single rotation of the winding stem in one direction and in the other, by means of a simplified construction mechanism.

Furthermore, when one of the power accumulators is wound by means of the coupling device, the other of the power accumulators is uncoupled, which means total absence of contact with the coupling device and therefore elimination of the risk of wear and tear, unlike unclicking.

The winding mechanism according to the invention is particularly suitable for winding a movement spring barrel forming one of the power accumulators and for winding a spring barrel of an independent automaton forming the other of the power accumulators.

The present invention likewise relates to a timepiece comprising a winding mechanism, as defined above.

BRIEF DESCRIPTION OF THE DRAWINGS

Other features and advantages of the invention will appear more clearly upon reading the following description of a particular embodiment of the invention, given by way of simple example which is illustrative and non-limiting, and annexed Figures, amongst which.

DETAILED DESCRIPTION OF A PREFERRED EMBODIMENT

The present invention relates to a winding mechanism of at least two power accumulators provided in a timepiece. These two accumulators can be independent, one of the other, or connected, for example at the level of the discharge. More particularly, in the description which follows, the two power accumulators are independent or autonomous, one of the power accumulators being a movement spring barrel supplying the base movement of the timepiece with power and the other of the power accumulators being for example an automaton spring barrel supplying an automaton provided in the timepiece. It is very evident that the power accumulators can be used in order to supply any other mechanism of a timepiece with power, for example a striking, independent second or alarm mechanism, or any other suitable mechanism.

In the example described below, the first power accumulator is formed by a first spring barrel, for example the movement spring barrel and the second power accumulator is formed by a second spring barrel, for example, the automaton spring barrel. However it is very evident that the roles can be reversed, the "first" or "second" character attributed in the present description to the movement spring barrel, respectively to the automaton spring barrel, not being limiting.

Figure 1:
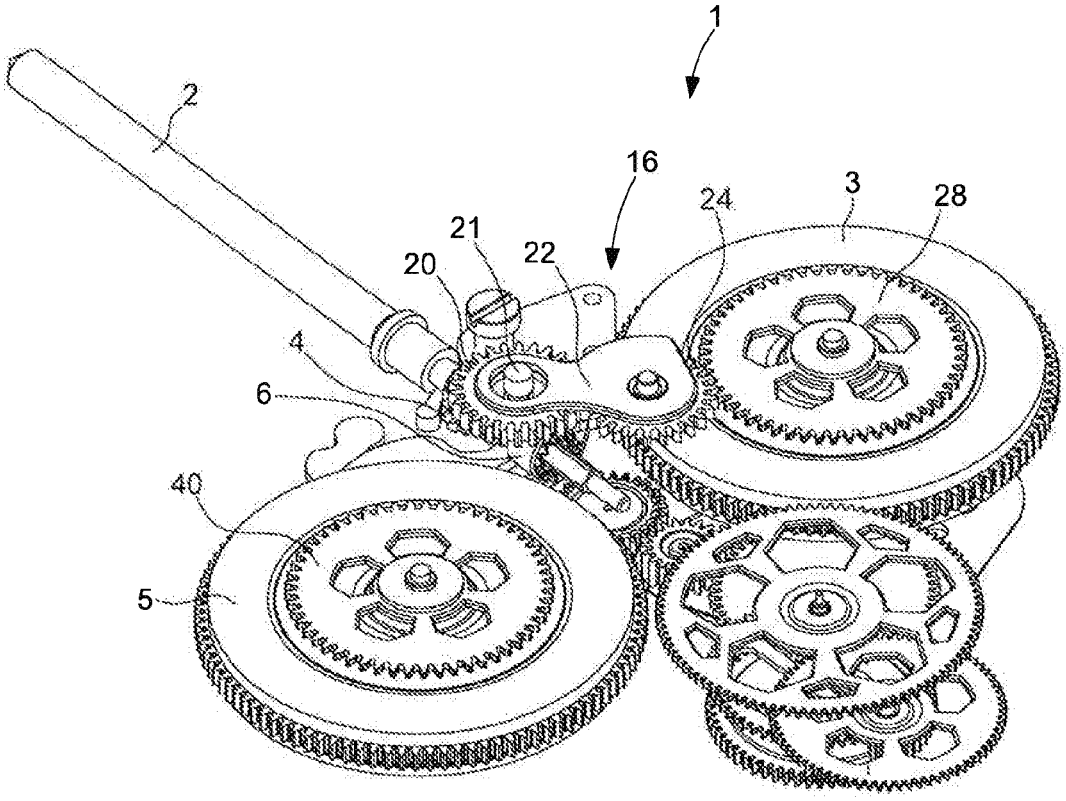
FIG. 1 is a perspective view, on the side of the bridges, of the winding mechanism according to the invention, the coupling device being in its first coupling position, the winding stem having been turned in clockwise direction.
Figure 2:
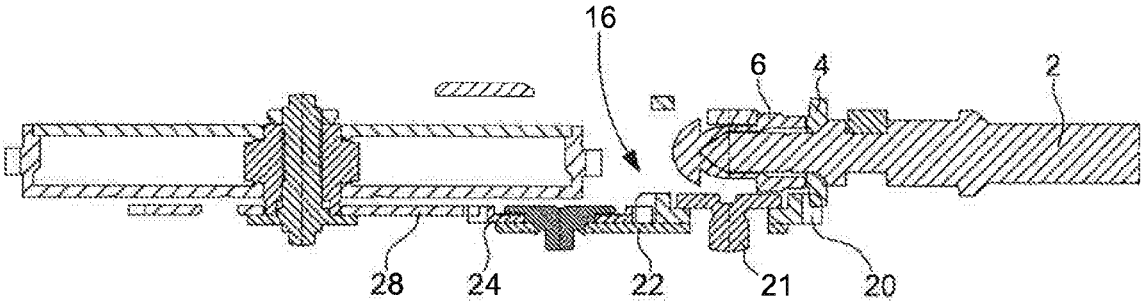
FIG. 2 is an opened-out sectional view of the coupling device in its first coupling position, on the side of the bridges.
Figure 3:
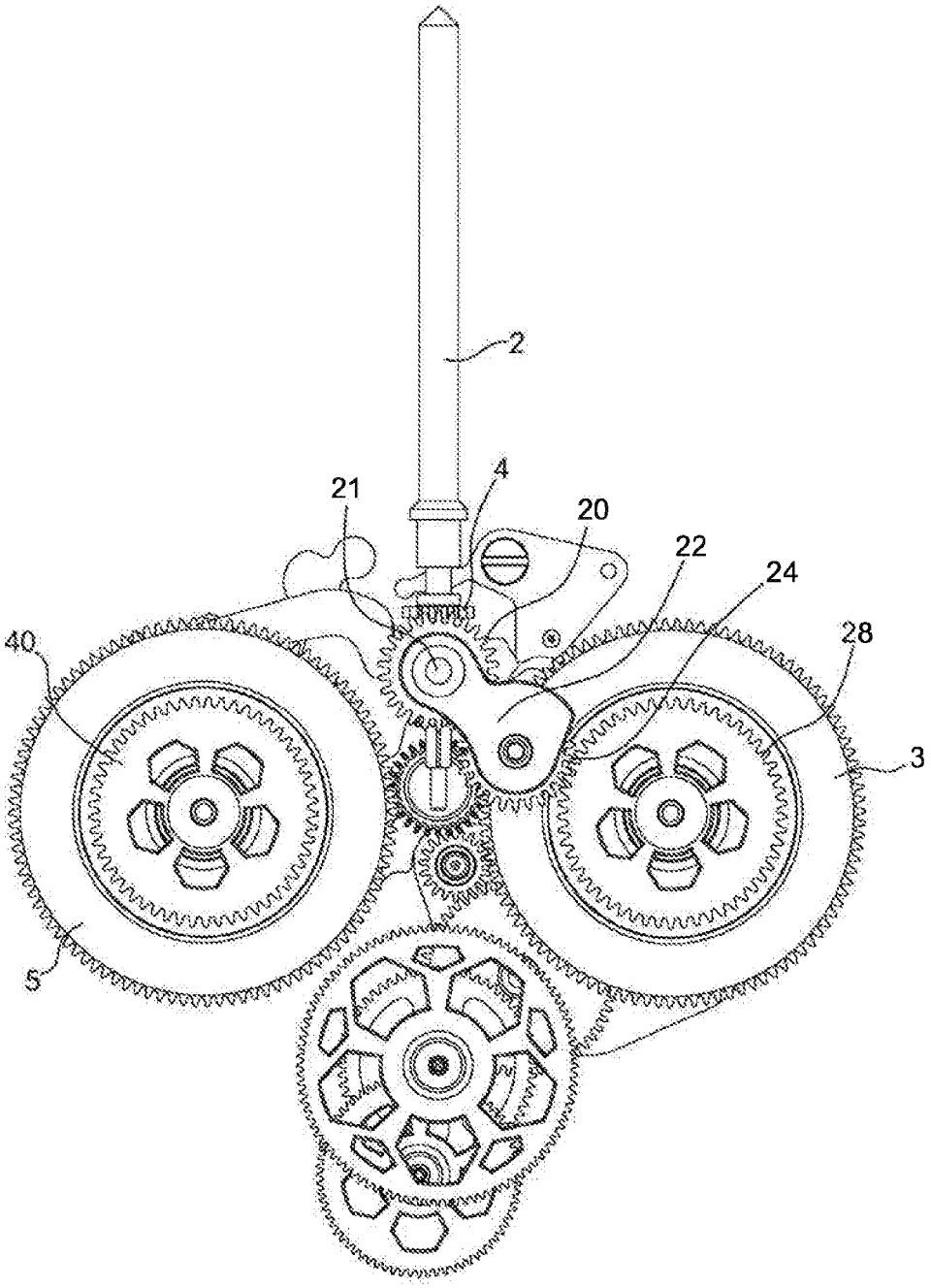
FIG. 3 is a view on the side of the bridge, of the winding mechanism according to the invention, the coupling device being in its first coupling position.

With reference in particular to FIGS. 1 and 2, there is represented a winding mechanism 1 of a timepiece which comprises, as standard, a winding stem 2 on which a winding pinion 4 and a sliding pinion 6 are mounted. The winding stem 2 is provided in order to be able to occupy at least two axial positions, i.e. a first winding position in which rotation of the winding stem 2 in one direction (here clockwise direction) winds the first power accumulator 3, i.e. the first spring barrel, and the rotation of the winding stem 2 in the other direction (here anticlockwise) winds the second power accumulator 5, i.e. the second spring barrel, as will be seen below, and a second position of setting the time, in which rotation of the winding stem in the two directions, clockwise and anticlockwise, makes it possible to set the time of the movement, none of the first and second power accumulators then being able to be wound whatever the direction of rotation of the winding stem. In a manner known to the person skilled in the art, the winding pinion 4 is mounted freely in rotation on a cylindrical part of the winding stem 2. The sliding pinion 6 has a square hole and is mounted to slide on a corresponding square provided at the end of the winding stem 2. The sliding pinion 6 can then slide between the winding position in which it meshes with the winding pinion 4 and the position for setting the time in which the sliding pinion 6 is separated from the winding pinion 4 and meshes with the mechanism for setting the time. Displacement of the sliding pinion 6 is ensured by a mechanism comprising a pull-out piece 7 and a lever 9, visible in FIG. 4. All these elements and mechanisms are known to the person skilled in the art and do not require more detailed description.

It will be noted however that, with respect to the difference from standard winding mechanisms, the sliding pinion and the winding pinion do not mesh via a Breguet toothing but have straight-edge toothings, which face one another, and are provided in order to allow driving of the winding pinion 4 by the sliding pinion 6 in the two directions of rotation, clockwise and anticlockwise, of the winding stem 2, said winding stem 2 and the sliding pinion 6 occupying the same axial winding position.

Figure 4:
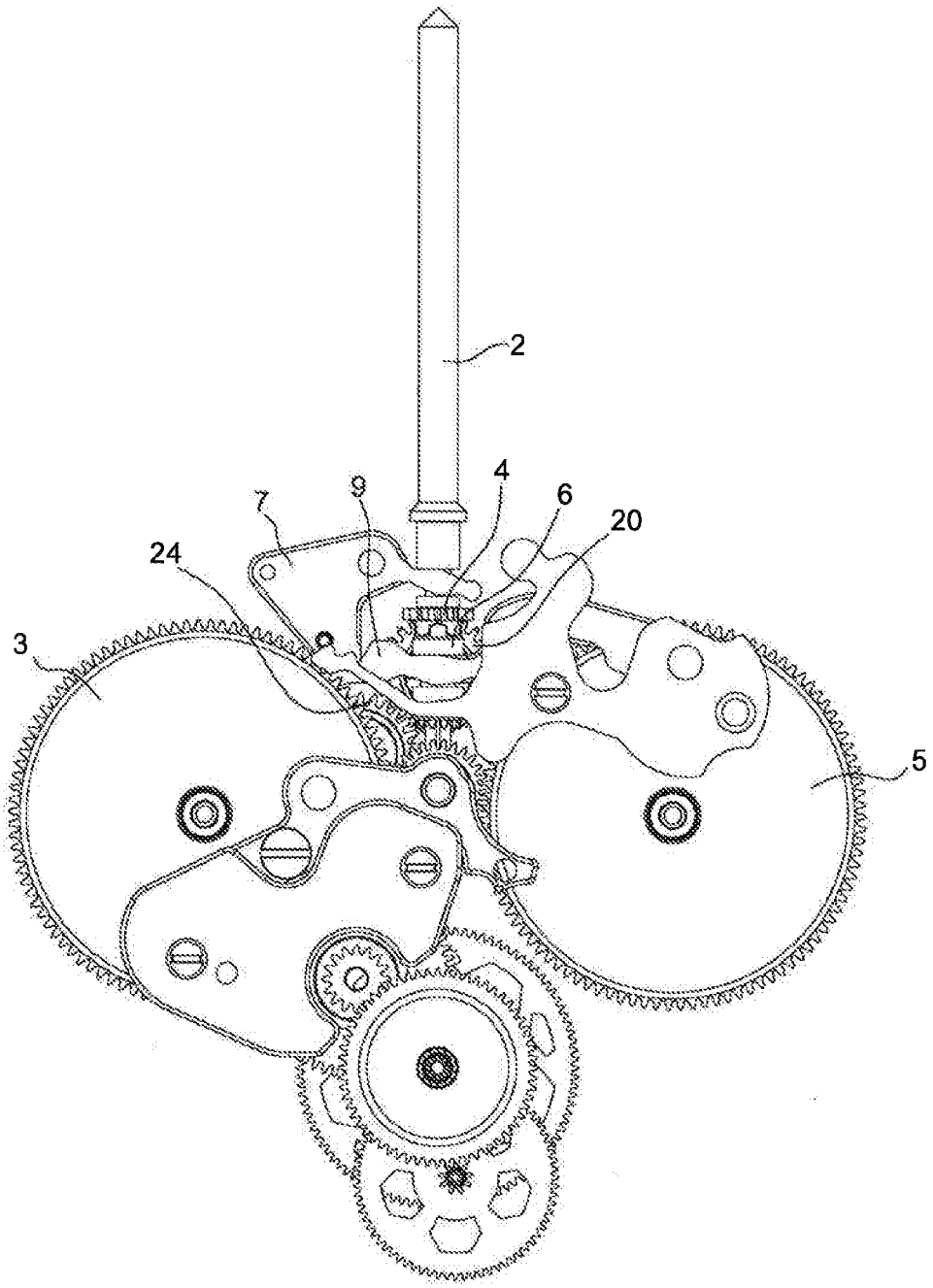
FIG. 4 is a view from the side of the dial, of the winding mechanism according to the invention, the coupling device being in its first coupling position.
Figure 6:
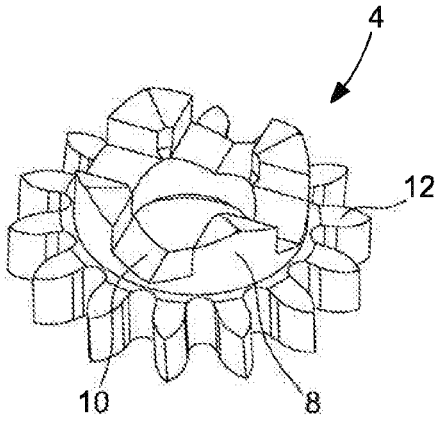
FIG. 6 is a perspective view of the winding pinion.
Figure 7:
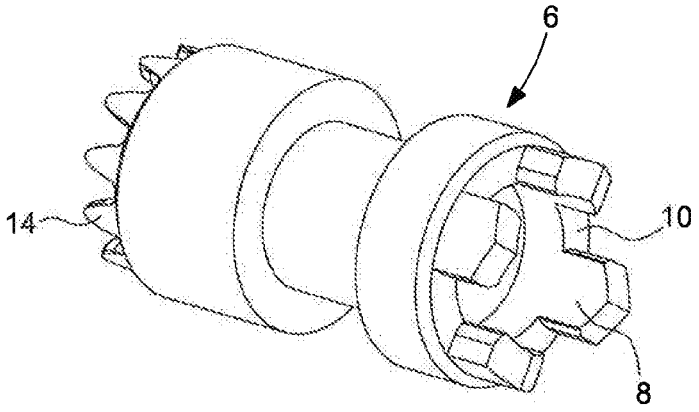
FIG. 7 is a perspective view of the sliding pinion.

With reference more particularly to FIGS. 6 and 7, the straight-edge toothings of the sliding pinion 6 and of the winding pinion 4 may be face gear or dog clutch teeth. To this end, the winding pinion 4 and the sliding pinion 6 have respectively, instead of a Breguet toothing, crenelated teeth 8, which end in two inclined faces meeting at the top of the crenelation and alternate with recesses 10 of a complementary shape to those of teeth 8, allowing said pinions to mesh by the engagement of the teeth 8 of one in the corresponding recesses 10 of the other. This edge, dog clutch tooth shape makes it possible for the sliding pinion 6 to fit ("in a "dog clutch" coupling) easily into the winding pinion 4 and to transmit more torque when they are in winding position, as FIG. 4 shows. These edge dog clutch toothings are likewise machinable without great constraint. In a manner known per se, the winding pinion 4 likewise comprises a peripheral toothing 12 which is provided in order to cooperate with the coupling device as will be detailed below. The sliding pinion 6 likewise comprises an edge toothing 14, opposite edge dog clutch toothing 8, provided in order to cooperate with the time-setting mechanism.

According to the invention, and with reference to FIGS. 1 to 4, the winding mechanism comprises a coupling device 16 which cooperates with the winding pinion 4.

Furthermore, the coupling device 16 is provided in order to occupy:

- a first coupling position according to which said coupling device 16 couples the winding pinion 4 and the first power accumulator 3 when the winding stem 2 is turned in one direction (here clockwise direction), the second power accumulator 5 then being uncoupled, without any contact with said coupling device 16, and
- a second coupling position according to which said coupling device 16 couples the winding pinion 4 and the second power accumulator 5 when the winding stem 2 is turned in the other direction (here anticlockwise direction), the first power accumulator 3 then being uncoupled, without any contact with said coupling device 16.

Between these two first and second coupling positions, the coupling device 16 can occupy intermediate and transitional positions in which it does not cooperate with any of the first and second power accumulators 3, 5.

According to the invention, the coupling device 16 comprises a crown wheel 20 which cooperates with the peripheral toothing 12 of the winding pinion 4 and on which a coupling lever 22 is mounted. Said coupling lever 22 carries, at its free end, a driving pinion 24 provided in order to be able to connect kinematically the crown wheel 20 to one or other of the first and second power accumulators 3, 5. More particularly, the driving pinion 24 is positioned on the coupling lever 22 and provided, on the one hand, in order to mesh with the crown wheel 20 and, on the other hand, to be able to mesh, according to the represented example, with either a first ratchet 28 which cooperates with the first power accumulator 3 when the coupling device 16 is in the first coupling position, or with a second ratchet 40 which cooperates with the second power accumulator 5 when said coupling device 16 is in the second coupling position. In the example described here, the first and second power accumulators 3, 5 are wound by their respective ratchet, anti-return mechanisms (not represented), such as pawl, spring or catch, known to the person skilled in the art, being provided at the level of the ratchet in order to prevent the ratchet from going into reverse. Furthermore, the first and second power accumulators 3, 5 have here opposite operational directions. The person skilled in the art knows how to arrange the components of the power accumulators 3, 5 (drum, spring, shaft), in order to have two spring barrels which operate in opposite directions. It is very evident that, in another non-represented variant, the winding of one of the spring barrels can take place via the drum in order to make the spring barrel turn in the opposite direction, and the driving pinion will then be provided in order to mesh with the drum of said spring barrel.

The coupling lever 22 is mounted freely on the axis 21 of said crown wheel 20 and the driving pinion 24 is mounted frictionally on said coupling lever 22 so that, insofar as the coupling device 16 does not occupy one of the coupling positions, said coupling lever 22 and the driving pinion 24 pivot integrally with said crown wheel 20 in order to pass:

into a first coupling position and to connect kinematically the driving pinion 24 to the first ratchet 28 of the first power accumulator 3, then, once the driving pinion 24 is in contact with the first ratchet 28 of the first power accumulator 3, the coupling lever 22 is prevented from continuing to pivot and the driving pinion 24 disengages from the coupling lever 22 thanks to friction, thus making possible driving of the driving pinion 24 by the winding pinion 4 via the crown wheel 20 in order to wind the first power accumulator 3 when the winding stem 2 is turned in a first direction, for example clockwise direction, the driving pinion 24 being in effect at a distance from the second power accumulator 5, into a second coupling position and to connect kinematically the driving pinion 24 to the second ratchet 40 of the second power accumulator 5, then once the driving pinion 24 is in contact with second ratchet 40 of the second power accumulator 5, the coupling lever 22 is prevented from continuing to pivot and the driving pinion 24 disengages from the coupling lever 22 thanks to friction, thus making possible driving of the driving pinion 24 by the winding pinion 4 via the crown wheel 20 in order to wind the second power accumulator 5 when the winding stem 2 is turned in a second inverse direction, for example anticlockwise direction, the driving pinion 24 being in effect at a distance from the first power accumulator 3.

It is very evident that the directions of rotation of the winding stem described here are not limiting and they can be reversed, the first power accumulator being able to be wound by rotation of the winding stem in anticlockwise direction, the second power accumulator being then wound by rotation of the winding stem in clockwise direction.

Furthermore, according to a preferred embodiment, the two power accumulators are disposed in the same plane, at an identical level of the timepiece. It is very evident that in one variant, not represented, the first and second power accumulators can be disposed at different levels, intermediate moving parts and/or gears being then used to be able to connect the coupling device kinematically to each of the power accumulators when it occupies the corresponding coupling position. Furthermore, use of intermediate moving parts and/or gears will be for the person skilled in the art to adapt as a function likewise of the direction of rotation of the other components of the construction, and in particular, for example, as a function of the directions of rotation of the spring barrels.

The operation of the winding mechanism according to the invention is the following: with reference to FIGS. 1 to 4, when it is necessary to wind the first power accumulator 3 or first spring barrel, the winding stem 2 is positioned in its axial winding position so that the sliding pinion 6 meshes with the winding pinion 4 as FIG. 4 shows, then the winding stem 2 is turned in clockwise direction. This rotation of the winding stem 2 drives the rotation of the winding pinion 4 in clockwise direction. The winding pinion 4 meshes with the crown wheel 20 in order to make it pivot in anticlockwise direction (looking at the dial). The coupling lever 22 and the driving pinion 24 being integral because of friction and the absence of torque transmission through the mechanisms, and the driving pinion 24 being engaged with crown wheel 20, the coupling lever 22 and the driving pinion 24 pivot integrally with said crown wheel 20 about its axis 21 in anticlockwise direction until the driving pinion 24 comes into contact with the first ratchet 28 of the first power accumulator 3. The coupling device 16 then occupies its first coupling position as FIGS. 1 to 4 show. Pivoting of the coupling lever 22 being however prevented, the driving pinion 24 disengages then from the coupling lever 22 thanks to friction, so that the rotation of the crown wheel 20 driven by the winding pinion 4 now drives rotation of the driving pinion 24 which meshes with the first ratchet 28 for the winding of the first spring barrel 3.

When it occupies its first coupling position, the coupling device 16 is positioned so that the kinematic chain which connects it to the second power accumulator 5 is inactive, the coupling device 16 having no contact with one of the components of this kinematic chain. In particular, this kinematic chain does not comprise any component in an unclicking position. More particularly, as FIGS. 1 to 4 show, the driving pinion 24, having pivoted with the coupling lever 22 into the first coupling position, no contact is then possible between the driving pinion 24 and the second ratchet 40, or any other intermediate component which is possibly provided.

Figure 5:
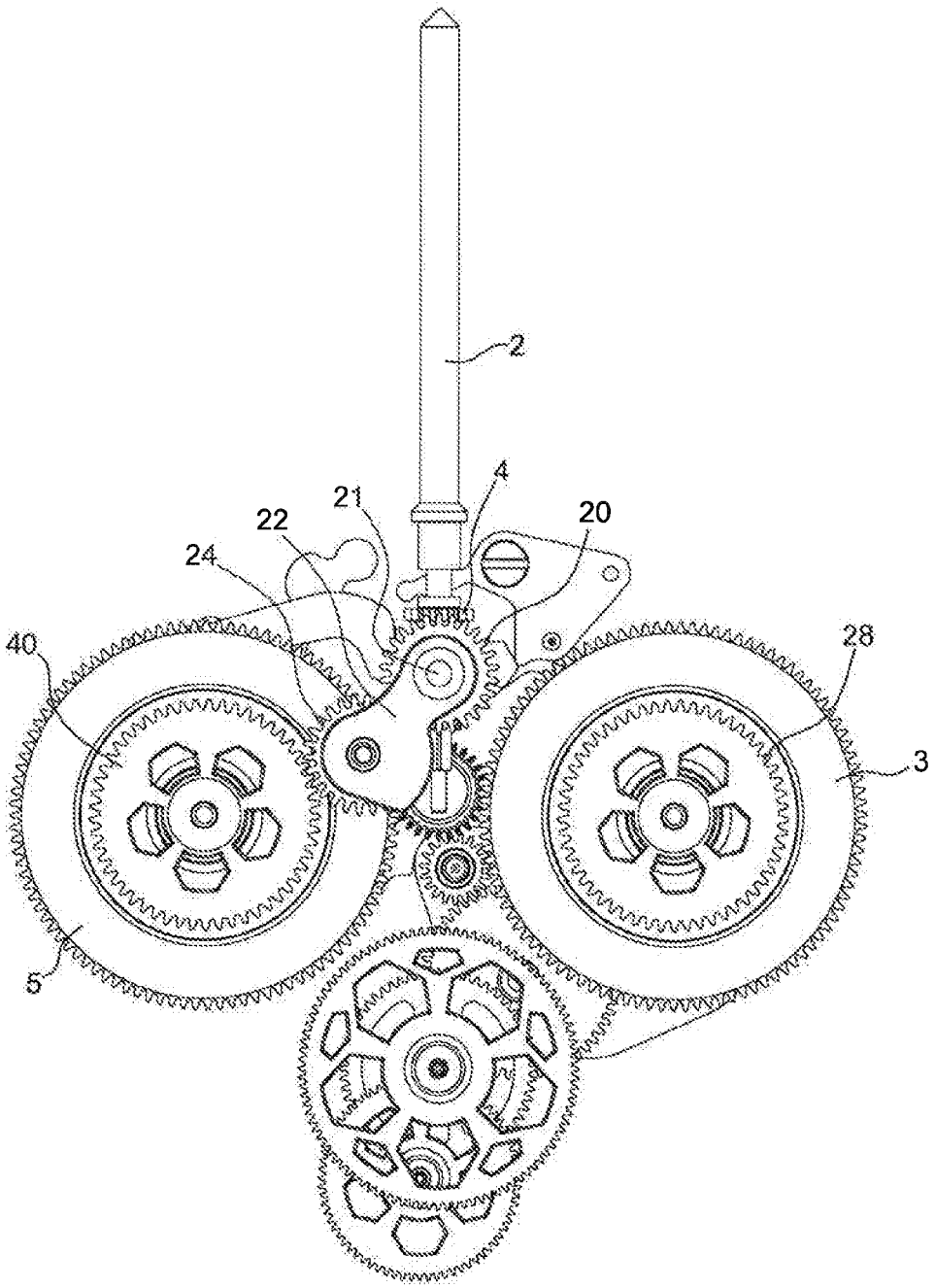
FIG. 5 is a view on the side of the bridges, of the winding device according to the invention, the coupling device being in its second coupling position, the winding stem having been turned in anticlockwise direction.

In order to wind the second power accumulator 5, with reference to FIG. 5, the winding stem 2 is always positioned in its axial winding position so that the sliding pinion 6, which is not displaced, always meshes with the winding pinion 4 (as FIG. 4 shows), then the winding stem 2 is turned in anticlockwise direction. This rotation of the winding stem 2 drives the rotation of the winding pinion 4 in anticlockwise direction. The winding pinion 4 meshes with the crown wheel 20 in order to make it pivot in clockwise direction (looking at the dial). The coupling lever 22 and the driving pinion 24 being integral because of friction and the absence of torque transmission through the mechanisms, and the driving pinion 24 always being engaged with the crown wheel 20, the coupling lever 22 and the driving pinion 24 pivot integrally with said crown wheel 20 about its axis 21 in clockwise direction until the driving pinion 24 comes into contact with the second ratchet 40 of the second power accumulator 5. The coupling device 16 then occupies its second coupling position represented in FIG. 5. Pivoting of the coupling lever 22 being however prevented, the driving pinion 24 disengages then from the coupling lever 22 thanks to friction, so that the rotation of the crown wheel 20 driven by the winding pinion 4 now drives rotation of the driving pinion 24 which meshes with the second ratchet 40 for the winding of the second spring barrel 5.

When it occupies its second coupling position, the coupling device 16 is positioned so that the kinematic chain which connects it to the first power accumulator 3 is inactive, the coupling device 16 having no contact with one of the components of this kinematic chain. In particular, this kinematic chain does not comprise any component in an unclicking position. More particularly, as FIG. 5 shows, the driving pinion 24, having pivoted with the coupling lever 22 into the second coupling position, is at a distance from the zone occupied by the first power accumulator 3, no contact then being possible between the driving pinion 24 and the first ratchet 28, or any other intermediate component which is possibly provided.

Hence, the winding mechanism according to the invention makes possible, by means of a device of simple construction, precise and reliable winding of two power accumulators by the single rotation of the winding stem in the two directions, the winding stem occupying the same axial winding position.

What is claimed is:

1. A winding mechanism of a timepiece comprising at least one first power accumulator provided in order to supply a first mechanism with power and a second power accumulator provided in order to supply a second mechanism with power, said winding mechanism comprising:

a winding stem, a winding pinion and a sliding pinion carried by said winding stem and having face gear toothings, facing one another, provided in order to allow driving of the winding pinion by the sliding pinion in the two directions of rotation of the winding stem, said winding stem and the sliding pinion occupying a same axial winding position, wherein the winding mechanism comprises a coupling device which cooperates with the winding pinion and is provided in order to occupy a first coupling position for coupling the winding pinion and the first power accumulator when the winding stem is turned in one direction, the second power accumulator being uncoupled, without any contact with said coupling device, and a second coupling position for coupling the winding pinion and the second power accumulator when the winding stem is turned in the other direction, the first power accumulator being uncoupled, without any contact with said coupling device, and wherein the coupling device comprises a crown wheel which cooperates with the winding pinion and on which a coupling lever is mounted, carrying a driving pinion provided in order to be able to connect kinematically the crown wheel to one or other of the first power accumulator and the second power accumulator, said coupling lever being mounted freely on the crown wheel and the driving pinion being mounted frictionally on the coupling lever so as to pivot integrally with said crown wheel into the first coupling position in order to connect kinematically the driving pinion to the first power accumulator, then to allow driving of the driving pinion by the crown wheel in order to wind the first power accumulator when the winding stem is turned in a first direction, and so as to pivot integrally with said crown wheel into the second coupling position in order to connect kinematically the driving pinion to the second power accumulator, then to allow driving of the driving pinion by the crown wheel in order to wind the second power accumulator when the winding stem is turned in a second inverse direction.

2. The winding mechanism according to claim 1, wherein the face gear toothings of the sliding pinion and of the winding pinion are dog clutch teeth.

3. The winding mechanism according to claim 2, wherein the sliding pinion and the winding pinion have respectively crenelated teeth ending in two inclined faces that meet at the top of the crenelation and alternate with recesses of complementary shape to those of the teeth, allowing said pinions to mesh by engagement of the teeth of one in the corresponding recesses of the other.

4. The winding mechanism according to claim 1, wherein the driving pinion is provided in order to be able to mesh with a first ratchet which cooperates with the first power accumulator when the coupling device is in the first coupling position, and to be able to mesh with a second ratchet which cooperates with the second power accumulator when the coupling device is in a second coupling position.

5. The winding mechanism according to claim 4, wherein, when the coupling device is in the first coupling position, the driving pinion is configured to mesh with the first ratchet such that the clutch lever is prevented from continuing to pivot and the driving pinion separates from the clutch lever due to friction and, when the coupling device is in the second coupling position, the driving pinion is configured to mesh with the second ratchet such that the clutch lever is prevented from continuing to pivot and the driving pinion separates from the clutch lever due to friction.

6. The winding mechanism according to claim 1, wherein the first power accumulator and the second power accumulator are disposed in the same plane.

7. A timepiece comprising:

at least one first power accumulator provided in order to supply a first mechanism with power;

a second power accumulator provided in order to supply a second mechanism with power; and a winding mechanism comprising a winding stem, a winding pinion and a sliding pinion carried by said winding stem and having face gear toothings, facing one another, provided in order to allow driving of the winding pinion by the sliding pinion in the two directions of rotation of the winding stem, said winding stem and the sliding pinion occupying a same axial winding position, wherein the winding mechanism comprises a coupling device which cooperates with the winding pinion and is provided in order to occupy a first coupling position for coupling the winding pinion and the first power accumulator when the winding stem is turned in one direction, the second power accumulator being uncoupled, without any contact with said coupling device, and a second coupling position for coupling the winding pinion and the second power accumulator when the winding stem is turned in the other direction, the first power accumulator being uncoupled, without any contact with said coupling device, and wherein the coupling device comprises a crown wheel which cooperates with the winding pinion and on which a coupling lever is mounted, carrying a driving pinion provided in order to be able to connect kinematically the crown wheel to one or other of the first power accumulator and the second power accumulator, said coupling lever being mounted freely on the crown wheel and the driving pinion being mounted frictionally on the coupling lever so as to pivot integrally with said crown wheel into the first coupling position in order to connect kinematically the driving pinion to the first power accumulator, then to allow driving of the driving pinion by the crown wheel in order to wind the first power accumulator when the winding stem is turned in a first direction, and so as to pivot integrally with said crown wheel into the second coupling position in order to connect kinematically the driving pinion to the second power accumulator, then to allow driving of the driving pinion by the crown wheel in order to wind the second power accumulator when the winding stem is turned in a second inverse direction.

8. The timepiece according to claim 7, wherein the face gear toothings of the sliding pinion and of the winding pinion are dog clutch teeth.

9. The timepiece according to claim 8, wherein the sliding pinion and the winding pinion have respectively crenelated teeth ending in two inclined faces that meet at the top of the crenelation and alternate with recesses of complementary shape to those of the teeth, allowing said pinions to mesh by engagement of the teeth of one in the corresponding recesses of the other.

10. The timepiece according to claim 7, wherein the driving pinion is provided in order to be able to mesh with a first ratchet which cooperates with the first power accumulator when the coupling device is in the first coupling position, and to be able to mesh with a second ratchet which cooperates with the second power accumulator when the coupling device is in a second coupling position.

11. The timepiece according to claim 10, wherein, when the coupling device is in the first coupling position, the driving pinion is configured to mesh with the first ratchet such that the clutch lever is prevented from continuing to pivot and the driving pinion separates from the clutch lever due to friction and, when the coupling device is in the second coupling position, the driving pinion is configured to mesh with the second ratchet such that the clutch lever is prevented from continuing to pivot and the driving pinion separates from the clutch lever due to friction.

12. The timepiece according to claim 7, wherein the first power accumulator and the second power accumulator are disposed in the same plane.

* * * * *